United States Patent [19]

Wearmouth

[11] 4,108,740

[45] Aug. 22, 1978

[54] HARD, HEAT-RESISTANT NICKEL ELECTRODEPOSITS

[75] Inventor: William Ronald Wearmouth, Halesowen, England

[73] Assignee: The International Nickel Company, Inc., New York, N.Y.

[21] Appl. No.: 800,579

[22] Filed: May 25, 1977

[30] Foreign Application Priority Data

May 28, 1976 [GB] United Kingdom ..... 22299/76

[51] Int. Cl.[2] ..... C25D 3/12; C25D 1/02; C25D 1/08

[52] U.S. Cl. ..... 204/11; 204/6; 204/43 T

[58] Field of Search ..... 204/3, 9, 25, 43 T, 204/6, 11; 428/680; 75/170

[56] References Cited

U.S. PATENT DOCUMENTS

| | | | |
|---|---|---|---|
| 2,242,865 | 5/1941 | Kihlgren | 75/170 |
| 2,304,059 | 12/1942 | Bieber et al. | 204/293 |
| 3,244,603 | 4/1966 | Stephenson et al. | 204/43 T |
| 3,282,689 | 11/1966 | Santner | 75/170 |
| 3,355,268 | 11/1967 | DuRose et al. | 204/43 T |
| 3,574,067 | 4/1971 | Spiro | 204/3 |
| 3,582,480 | 6/1971 | Chorne | 204/37 R |
| 3,713,997 | 1/1973 | Anselrode | 204/9 |
| 3,759,799 | 9/1973 | Reinke | 204/9 |
| 3,763,030 | 10/1973 | Zimmer | 204/9 |

OTHER PUBLICATIONS

Vanaja, T. S., and Char, T. L. R., "Electrodeposition of Manganese Alloys . . . " Metal Finishing, Feb. 1971, p. 59.

Nagirnyi, V. M., Isaeva, L. G., et al., "Electrolytic Production. . . . " Vopr Khim. Khim. Tekhnol. Resp. Mezhued. Tenet. Nauch. Tekhn. SB. 1973, vol. 29, pp. 109–113.

Spencer, A. G., "The Corrosion of Nickel Anodes", The Metal Industry vol. 50, pp. 141–144, 1937.

*Primary Examiner*—John H. Mack
*Assistant Examiner*—William T. Leader
*Attorney, Agent, or Firm*—Ewan C. MacQueen; Raymond J. Kenny; Walter A. Petersen

[57] ABSTRACT

An article such as a screen printing cylinder prepared from a hard nickel electrodeposit is characterized by improved resistance to embrittlement when exposed to temperatures above about 200° C. Electrodeposits affording improved resistance to embrittlement contain 0.007–1% sulfur and 0.02–5% manganese. The amount of manganese in the electrodeposits is correlated to the amount of sulfur present so that the manganese is present in an amount in excess of the stoichiometric amount required to form manganese sulfide. The electrodeposits which are also characterized by usefully low levels of internal stress are prepared using conventional nickel plating baths modified by the addition of sources of manganese ions and sulfur.

19 Claims, No Drawings

HARD, HEAT-RESISTANT NICKEL ELECTRODEPOSITS

This invention relates to the production of hard, heat-resistant nickel-base electrodeposits by electrodeposition techniques which are particularly suitable for use in electroforming.

The production of electroforms involves building up deposits of adequate thickness on a mandrel. This requires that the stress in the deposit should not be so high as to cause premature separation of the deposit from the mandrel. The electroformability and hardness of nickel can be improved by electrodepositing the nickel from an electrolyte containing addition agents which introduce sulfur into the resulting electrodeposit. However, while sulfur improves electroformability by reducing the internal stress in the electrodeposit, it does so at the expense of ductility. Sulfur contents in excess of approximately 0.005% cause the electrodeposit to embrittle upon exposure to temperatures above about 200° C. Embrittlement at temperatures above ambient is particularly disadvantageous in electroforms requiring exposure to elevated temperatures, in applications such as molds and dies, or in fabrication such as screen printing cylinders which can be subjected to localized heating by brazing, welding or by the use of heat curable glues, or during surface masking using heat curable lacquers.

It has now been discovered that nickel electrodeposits and/or electroforms can be prepared that provide usefully low levels of internal stress and resistance to embrittlement when heated to temperatures above ambient.

Generally speaking, the present invention is directed to an article consisting of or including a hard nickel electrodeposit exposed in use or manufacture to temperatures exceeding 200° C, said electrodeposit containing, in weight percent, from about 0.007 to about 1% sulfur and sufficient manganese, in the range of from about 0.02% to about 5%, in excess of a stoichiometric amount necessary to form manganese sulfide with the sulfur, to improve embrittlement resistance of said electrodeposit at temperatures exceeding 200° C.

Although the mechanism by which the embrittlement is reduced is not completely understood and without being bound to any particular theory, it appears that when the manganese containing electrodeposit is exposed to temperatures in excess of 200° C, harmful brittle grain boundary films of nickel sulfide are not formed. Possibly this may be due to the formation of less harmful manganese sulfides in preference to nickel sulfides at temperatures greatly in excess of 200° C. Although at temperatures up to about 400° C, significant amounts of manganese sulfide are unlikely to form, surprisingly grain boundary nickel sulfides are not formed either. Nevertheless, the amount of manganese deposited must be in the range of from 0.02 to 5% by weight and in excess of the stoichiometric amount necessary to form manganese sulfide with 0.007 to 1% by weight sulfur present in the electrodeposit. This means that in the electrodeposit, the manganese content must be at least 1.71 times the sulfur content. Moreover, it is found that the presence of manganese with the nickel and sulfur in the electrodeposit does not detrimentally increase the stress in the electrodeposit such as to prevent electroforming. This is surprising as the presence of manganese alone in a nickel electrodeposit raises the stress sufficiently to make electroforming very difficult if not impossible.

Whatever the mechanism behind the reduction of embrittlement, the electrolyte used to form the electrodeposit in the article of the invention contains a source of nickel ions, preferably in the form of nickel sulfate or sulfamate, with or without other conventional additions such as nickel chloride and/or boric acid. Suitable electrolytes include sulfate-chloride electrolytes of the conventional Watts or high-chloride types, conventional sulfamate electrolytes or high sulfamate electrolytes such as described in U.S. Pat. Nos. 3,326,782, 3,374,154, and U.K. Pat. No. 1,101,093. One such high sulfamate electrolyte widely used for the electroforming of nickel and known as the "Ni-Speed" electrolyte, contains from 550 to 650 g/l (grams per liter) of nickel sulfamate, from 5 to 15 g/l of nickel chloride, and 30 to 40 g/l of boric acid.

The electrolyte also contains a source of sulfur and a source of manganese ions. The source of sulfur conveniently is a sulfur bearing organic compound, preferably an aryl compound containing a functional sulfonate group. A suitable source of sulfur is O-benzoic sulfimide or the sodium salt of napthalene tri-sulfonic acid, and more preferably it is sodium benzosulfimide ($C_8H_4COSO_2NNa.2H_2O$) also commonly known as soluble saccharin and saccharin sodium. Optionally the electrolyte may contain a secondary brightener such as butyne diol.

Preferably the source of sulfur is present in the electrolyte in an amount sufficient to introduce more than 0.02% by weight sulfur into the resulting electrodeposit. Advantageously, no more than 0.065% sulfur should be introduced into the electrodeposit. When the source of sulfur is saccharin sodium, it is preferably added to the electrolyte in an amount in the range of from 0.1 to 0.4 g/l (e.g., 0.25 g/l) to provide a range of available sulfur in the electrolyte of from 0.01 to 0.065 g/l. As will be understood by those skilled in the art, due to the limited solubility of aryl compounds in aqueous solutions, the upper limit for reducible sulfur should not be considered to be precisely defined.

Preferably, the source of manganese ions is one or more of manganese sulfamate, sulfate, and chloride and other soluble manganese compounds compatible with the electrolyte. Moreover, to facilitate incorporation of the desired amount of manganese in the electrodeposit, the concentration of the manganese ions in the electrolyte preferably is related to the current density used in the electrodeposition process. To this end, the current density should be in the range of 2.7 to 20 A/dm$^2$ (amperes per square decimeter), preferably in the range of 4.3 to 12.9 A/dm$^2$ e.g., 6, 8, or 10 A/dm$^2$), with the manganese ion concentration in the electrolyte preferably being in the range of from 12 to 20 g/l. In general, increasing the concentration of manganese ions in the electrolyte facilitates the incorporation of manganese in the electrodeposit. Advantageously, from 0.03 to 3.5% manganese, preferably from 0.07 to 0.35%, and more preferably from 0.1 to 0.25% manganese, should be incorporated in the electrodeposit. Conveniently, at least 0.07%, and more preferably at least 0.1% manganese, should be incorporated together with from 0.02 to 0.065%, preferably from 0.025 to 0.040%, sulfur to minimize embrittlement of the electrodeposit on heating.

As aforesaid, in electrodeposits according to the invention the manganese content of from 0.02 to 5% must be greater than the stoichiometric amount necessary to form manganese sulfide (MnS). Preferably, the amount of manganese present should exceed the stoichiometric amount by at least 0.03%. Advantageously, the manganese content should not be more than 0.08% in excess of twice the stoichiometric amount.

Preferably, electrodeposits produced according to the invention contain, excluding impurities, only nickel, manganese, and sulfur. Normal impurities which may be present include carbon and cobalt, usually present only in trace amounts. However, some of the nickel present may optionally be replaced by iron and/or cobalt.

For the purpose of giving those skilled in the art a better understanding of the invention, the following examples are given.

EXAMPLE I

A conventional "Ni-Speed" electrolyte was used containing 560 g/l nickel sulfamate ($Ni(SO_3NH_2)_2.4H_2O$), 8 g/l nickel chloride ($NiCl_2.H_2O$), and 33 g/l boric acid ($H_3BO_3$). Manganese was added to portions of this electrolyte in the form of manganese sulfamate or manganese sulfate, and sulfur was added in the form of saccharin sodium. Electrodeposits were formed by plating from the electrolyte at a temperature of 60° C on stainless steel cathodes, as foils with a thickness of approximately 200 microns for Samples A, B, C, 1 and 2 using manganese sulfamate as a source of manganese in the electrolyte, and on stainless steel mandrels, as cylinders 35 mm (millimeters) long, 30 mm in diameter, and 100 microns thick for Samples 3 to 6 and D using manganese sulfate as a source of manganese in the electrolyte. The samples were stripped from the cathodes or mandrels and hardness measurements made on the samples on a Vickers diamond pyramid indentation machine at a load of 1.0 kg (kilogram) at room temperature both as-plated and after heating for various temperatures and times. Preferred samples according to the present invention have as-plated hardness greater than about 370 Hv.

plated samples was measured using a modified Brenner-Senderoff spiral contractometer.

As can be seen from the results of Table I, the pure nickel electrodeposit, Sample A, outside the scope of the present invention, had a hardness of only 245 Hv as-plated and a compressive internal stress adequate to permit both general and cylinder electroforming. Sample A was ductile, and the hardness decreased substantially after exposures at 450° and 600° C.

The 0.02% sulfur containing nickel electrodeposit, Sample B, outside the scope of the present invention, had a higher as-plated hardness than Sample A, higher retained hardness after elevated temperature exposure, and more compressive internal stress such as to permit cylinder electroforming but not general electroforming. However, Sample B embrittled catastrophically as indicated by zero reverse bends in the ductility test after heating at 450° or 600° C.

The 0.10% manganese containing electrodeposit, Sample C, also outside the scope of the present invention, had lower as-plated hardness than the pure nickel Sample A, better resistance to embrittlement than Sample B, but an internal tensile stress too high (+240 $N/mm^2$) for satisfactory foil formation or commercial electroforming or for anything but limited property measurements.

In contrast to these results, the manganese and sulfur containing nickel electrodeposit, Samples 1 to 6, prepared according to the present invention, all generally had higher as-plated and retained hardnesses than Samples A and C, and similar or better resistance to embrittlement at elevated temperatures than Sample B, coupled with internal stress values permitting satisfactory cylinder electroforming and in some instances general electroforming.

Furthermore, increasing the content of the manganese source in the sulfur-containing electrolyte and increasing the current density increased the amount of manganese in the electrodeposit, increased the as-plated

TABLE I

ELECTRODEPOSITS PREPARED WITH MODIFIED "NI-SPEED" ELECTROLYTES

| Sample | Mn concentration in electrolyte g/l | Saccharin concentration in electrolyte g/l | Current Density $A/dm^2$ | Electrodeposit Composition in Weight Percent Mn | Electrodeposit Composition in Weight Percent S | Electrodeposit Hardness(Hv) As-plated | Electrodeposit Hardness(Hv) After 22 hours at 450° C | Electrodeposit Hardness(Hv) After 18 hours at 600° C | Ductility, No. of Reverse Bends After 22 hours at 450° C | Ductility, No. of Reverse Bends After 18 hours at 600° C | Stress (1) $N/mm^2$ |
|---|---|---|---|---|---|---|---|---|---|---|---|
| A | 0 | 0 | 6.5 | <0.02 | 0.001 | 245 | 145 | 87 | 33 | 11 | −35 |
| B | 0 | 0.25 | 6.5 | <0.02 | 0.020 | 473 | 182 | 124 | 0 | 0 | −58 |
| C | 20 | 0 | 6.5 | 0.10 | 0.005 | 200 | (2) | (2) | 9 | (2) | +240 |
| 1 | 20 | 0.25 | 2.7 | 0.03 | 0.017 | 389 | 158 | 98 | 2 | 1 | −62 |
| 2 | 20 | 0.25 | 6.5 | 0.15 | 0.032 | 498 | 215 | 140 | 11 | 15 | −48 |
| D | 14 | 0.25 | 4.3 | 0.03 | 0.018 | 398 | 169 | 100 | 0 | 0 | −86 |
| 3 | 14 | 0.25 | 6.5 | 0.06 | 0.022 | 405 | 177 | 100 | 3 | 0 | −80 |
| 4 | 14 | 0.25 | 8.6 | 0.10 | 0.023 | 405 | 183 | 100 | 4 | 2 | −91 |
| 5 | 14 | 0.25 | 10.8 | 0.11 | 0.023 | 410 | 197 | 100 | 4 | 5 | −62 |
| 6 | 14 | 0.25 | 12.9 | 0.17 | 0.026 | 443 | 193 | 100 | 8 | 20 | +36 |

(1) Negative stress is compressive; positive stress is tensile.
(2) Not determined since internal stress was too high for satisfactory plating of foil.

Table I shows the results of tests on Samples A to D, which are outside the invention and Samples 1 to 6, according to the invention. The samples were also analyzed for manganese and sulfur content. The ductility of the samples after stripping was measured at room temperature, on strips 12 mm wide cut therefrom, after heating for 22- and 18-hour time periods at 450° and 600° C, respectively, as the number of reverse bends through 90° before fracture. Internal stress of the as- and retained hardnesses, improved the resistance to embrittlement at temperatures in excess of 200° C, and although increasing the level of internal stress somewhat, the internal stress level was generally suitable for cylinder electroforming. Sample D, which contained slightly less manganese than the stoichiometric amount necessary to form manganese sulfide with all the sulfur present and which is outside the invention, in general had poorer retained ductility than the Samples 1 to 6 made according to the invention.

With the conventional "Ni-Speed" electrolyte, the electrodeposit of the present invention preferably is made at current densities greater than 6.5 A/dm$^2$ with manganese concentrations in excess of 14 g/l and saccharin sodium concentrations of approximately 0.25 g/l to introduce at least 0.1% manganese into the electrodeposit.

EXAMPLE II

An electrolyte more commonly employed than the "Ni-Speed" electrolyte is the Watts type electrolyte which uses commercially available manganese sulfate as the source of manganese ions rather than manganese sulfamate, the latter ingredient generally requiring laboratory preparation. A Watts type electrolyte was used containing 285 g/l nickel sulfate ($NiSO_4$), 29 g/l nickel chloride ($NiCl_2$), 40 g/l boric acid ($H_3BO_3$), and 0.25 g/l sodium benzosulfimide (saccharin sodium). Manganese was added to this electrolyte in the form of a solution of manganese sulfate to give a manganese content in the electrolyte of 16 g/l. Nickel was electrodeposited from the electrolyte at a pH of 4 and a temperature of 60° C at different manganese and sulfur concentrations and various current densities onto a stainless steel mandrel as cylinders 35 mm long and 30 mm diameter × 100 microns thick. Satisfactory electroformed samples were separated from the mandrel and hardness values were measured at room temperature together with the manganese and sulfur contents, the internal stress and ductility after heating, using the techniques of Example I, with the results shown in Table II.

TABLE II

ELECTRODEPOSITS PREPARED WITH MODIFIED WATTS TYPE ELECTROLYTES

| Sample | Current Density A/dm$^2$ | Electrodeposit Compositon in Weight Percent Mn | S | Electrodeposit Hardness (Hv) As-plated | After 22 hours at 450° C | After 18 hours at 600° C | Ductility, No. of Reverse Bends After 22 hours at 450° C | After 18 hours at 600° C | Stress (1) N/mm$^2$ |
|---|---|---|---|---|---|---|---|---|---|
| E | 4.3 | 0.03 | 0.024 | 240 | 136 | 113 | 0 | 0 | −43 |
| F | 6.5 | 0.05 | 0.030 | 274 | 140 | 136 | 0 | 0 | −62 |
| 7 | 8.6 | 0.16 | 0.033 | 408 | 200 | 147 | 3 | 4 | −59 |
| 8 | 10.8 | 0.20 | 0.034 | 418 | 200 | 144 | 5 | 4 | −56 |
| 9 | 12.9 | 0.22 | 0.035 | 437 | 210 | 163 | 6 | 6 | −53 |

(1) Negative stress is compressive.

As can be seen from Table II, the conditions used to produce the Samples 7 to 9 according to the present invention and Samples E and F, outside the invention, gave satisfactory cylinder electroforms. However, Samples E and F with less manganese than the stoichiometric amount necessary to form manganese sulfide with the sulfur present had low as-plated and retained hardness and exhibited poor ductility. Optimum results were obtained with Samples 7 to 9 by increasing the sulfur and manganese contents to an optimum in excess of about 0.1% manganese and about 0.03% sulfur and by using a current density preferably of at least 8.6 A/dm$^2$, whereupon increasing as-plated and retained hardness values and increasing ductility values after heating to 450° and 600° C were obtained with increasing current density and increasing manganese and sulfur contents.

EXAMPLE III

The effect of varying the saccharin sodium (a primary brightener) concentration together with the effect of the presence of a secondary brightener such as butyne diol in an electrolyte of Example II is shown in this example.

A conventional Watts type electrolyte was used containing 285 g/l nickel sulfate ($NiSO_4$), 26 g/l nickel chloride ($NiCl_2$), 37.7 g/l boric acid ($H_3BO_3$), 15 g/l manganese sulfate ($MnSO_4$), and 0.25 g/l sodium benzosulfimide ($C_6H_4COSO_2NNa.2H_2O$).

The secondary brightener butyne diol was added to the electrolyte in concentrations of 0.10 and 0.25 g/l and metal was electrodeposited onto a stainless steel mandrel as foil 50 × 50 mm × 100 microns thick at a current density of 4.3 A/dm$^2$, under the conditions and with the results shown in Table III, in which Samples 10 and 11 were made according to the invention. All conditions and methods of measurement were as in Example II.

TABLE III

ELECTRODEPOSITS PREPARED WITH MODIFIED WATTS TYPE ELECTROLYTES CONTAINING SECONDARY BRIGHTENER

| Sample | Butyne Diol concentration g/l | Electrodeposit Composition in Weight Percent, Mn | S | Electrodeposit Hardness (Hv) As-plated | After 22 hours at 450° C | After 18 hours at 600° C | Ductility, No. of Reverse Bends After 22 hours at 450° C | After 18 hours at 600° C | Stress (1) N/mm$^2$ |
|---|---|---|---|---|---|---|---|---|---|
| 10 | 0.10 | 0.06 | 0.021 | 289 | 191 | 82 | 3 | 5 | +31 |
| 11 | 0.25 | 0.30 | 0.061 | 577 | 245 | 191 | 10 | 9 | +55 |

(1) Positive stress is tensile.

Additions of 0.10 and 0.25 g/l butyne diol to electrolytes containing 0.25 g/l saccharin sodium had the effect of allowing greater amounts of manganese to be deposited with the same current densities than were necessary in the absence of butyne diol. For example, with 0.10 g/l butyne diol and 0.25 g/l saccharin sodium, the Sample 10 electroform obtained at 4.3 A/dm$^2$ contained 0.06% manganese and 0.021% sulfur in comparison with Sample E of Example II, obtained from a butyne diol free electrolyte at 4.3 A/dm$^2$, which contained 0.03% manganese and 0.024% sulfur. Comparison of the results in Table II and Table III for Samples E, 10, and 11 show that in general butyne diol additions increase the as-plated hardness, the retained hardness and ductility after heating at 450° and 600° C and the internal stress in a tensile direction. Preferably, with butyne diol additions saccharin sodium additions should be at least 0.25 g/l.

EXAMPLE IV

Another suitable electrolyte for the practice of the present invention is the conventional sulfamate electrolyte containing 280 g/l nickel sulfamate ($Ni(SO_3NH_2)_2.4H_2O$), 5 g/l nickel chloride ($NiCl_2$), 35 g/l boric acid ($H_3BO_3$), and 0.25 g/l sodium benzosulfimide ($C_6H_4COSO_2NNa.2H_2O$). Manganese was added to this electrolyte in the form of manganese sulfate ($MnSO_4$) to give a manganese content in the electrolyte of 13 g/l. Experimental details were the same as for Example I and the electroformed Samples G, H, and 12 to 14 were in the form of cylinders 35 mm long, 300 mm in diameter, and 100 microns thick. Samples 12 to 14 were made according to the invention, whereas Samples G and H were outside the present invention, and gave the results recorded in Table IV.

TABLE IV

ELECTRODEPOSITS PREPARED WITH MODIFIED SULFAMATE ELECTROLYTES

| Sample | Current Density A/dm$^2$ | Electrodeposit Compositon in Weight Percent Mn | S | Electrodeposit Hardness (Hv) As-plated | After 22 hours at 450° C | After 18 hours at 600° C | Ductility, No. of Reverse Bends After 22 hours at 430° C | After 18 hours at 600° C | Stress (1) N/mm$^2$ |
|---|---|---|---|---|---|---|---|---|---|
| G | 4.3 | 0.02 | 0.040 | 295 | 136 | 136 | 0 | 0 | −95 |
| H | 6.5 | 0.06 | 0.037 | 333 | 140 | 82 | 0 | 0 | −98 |
| 12 | 8.6 | 0.10 | 0.040 | 378 | 177 | 93 | 0 | 1 | −100 |
| 13 | 10.8 | 0.12 | 0.033 | 420 | 170 | 93 | 1 | 10 | −94 |
| 14 | 12.9 | 0.18 | 0.031 | 420 | 190 | 139 | 6 | 15 | +17 |

(1) Negative stress is compressive; positive stress is tensile.

As can be seen from the results of Table IV, the highest hardness properties as-plated and after heating to 450° and 600° C and the best ductility properties were obtained with manganese contents of at least 0.1% using current densities of at least 8.6 A/dm$^2$. The Samples G and H which both contained less manganese than the stoichiometric amount necessary to form manganese sulfide with the sulfur present generally had low as-plated and retained hardness and poor retained ductility.

EXAMPLE V

A further suitable electrolyte for the practice of the present invention is a high chloride electrolyte containing 280 g/l nickel sulfate ($NiSO_4$), 75 g/l nickel chloride ($NiCl_2$), 40 g/l boric acid ($H_3BO_3$), 0.25 g/l saccharin sodium ($C_6H_4COSO_2NNa.2H_2O$), and 12 g/l manganese sulfate ($MnSO_4$).

Experimental details for this example were the same as for Example II. The electroformed Samples 15–17 were made according to the invention, and Samples J and K were outside the invention (Table V). The results of tests on Samples 15 to 17 at constant manganese and saccharin sodium concentrations showed that the amount of manganese in the electroform, the hardness (as-plated and after heating at 450° and 600° C) and resistance to embrittlement (when heated at 450° and 600° C) all increased with increasing current density reaching an optimum at current densities of at least 8.6 A/dm$^2$ and at manganese contents of at least about 0.07%. Samples J and K, containing less manganese than the stoichiometric amount necessary to form manganese sulfide with the sulfur present, had generally lower retained hardnesses and poorer ductility than the Samples 15 to 17.

TABLE V

ELECTRODEPOSITS PREPARED WITH MODIFIED HIGH-CHLORIDE ELECTROLYTES

| Sample | Current Density A/dm$^2$ | Electrodeposit Composition in Weight Percent Mn | S | Electrodeposit Hardness (Hv) As-plated | After 22 hours at 450° C | After 18 hours at 600° C | Ductility, No. of Reverse Bends After 22 hours at 450° C | After 18 hours at 600° C | Stress (1) N/mm$^2$ |
|---|---|---|---|---|---|---|---|---|---|
| J | 4.3 | 0.03 | 0.027 | 274 | 130 | 122 | 0 | 0 | −42 |
| K | 6.5 | 0.05 | 0.030 | 410 | 174 | 95 | 0 | 0 | −55 |
| 15 | 8.6 | 0.09 | 0.030 | 420 | 185 | 100 | 2 | 7 | −46 |
| 16 | 10.8 | 0.08 | 0.029 | 424 | 185 | 100 | 3 | 7 | −49 |
| 17 | 12.9 | 0.14 | 0.032 | 432 | 169 | 142 | 5 | 10 | −32 |

(1) Negative stress is compressive.

As shown by the results of Examples I through V, satisfactory resistance to embrittlement at temperatures in excess of 200° C is obtained with articles according to the invention, consisting of or including electrodeposits made from electrolytes operated in the range of 4.3 to 12.9 A/dm$^2$, preferably 6.5, 8.6, or 10.8 to 12.9 A/dm$^2$, with the manganese ion concentration conveniently in the range of from 12 to 20 g/l. In general, increasing the manganese concentration in the electrolyte allows satisfactory manganese contents, preferably at least 0.1%, to be incorporated in the electrodeposit at lower current densities while still obtaining satisfactory resistance to embrittlement at temperature in excess of 200° C.

Although the invention allows the production of articles consisting of or including electrodeposits for any application in which resistance to abrasion, wear, and embrittlement at temperatures in excess of 200° C is desirable (such as for electroformed dies and molds for the production of aluminum and zinc die castings), the invention is particularly suitable for the production of electroformed screen printing cylinders. Customarily, screen printing cylinders are electroformed so that a nickel coating, nominally 100 to 200 microns thick, is applied to a cylindrical mandrel part immersed and rotated in the electrolyte. To improve the hardness and thereby the abrasion resistance of the cylinder and to enable it to be removed from the mandrel, organic stress-reducing agents have to be used which introduce sulfur into the electroform. This sulfur content causes the electrodeposit to have a compressive stress which facilitates separation from the mandrel but leads to embrittlement if the cylinder is heated to temperatures in excess of 200° C.

Because of this lack of resistance to embrittlement such cylinders must be fabricated at temperatures considerably below 200° C and this restricts the type of photoresist masking lacquers suitable and prevents end pieces being attached in any way other than by gluing. On the contrary, screen printing cylinders produced according to the invention have lessened embrittlement when exposed to temperatures in excess of 200° C. Because of this, such cylinders can safely be subjected to higher furbishing temperatures. This allows the use of more effective lacquers and glues with higher curing temperatures, or even allows end plates to be attached to the cylinders by welding and/or brazing. Furthermore, such cylinders can be repaired using welding and brazing techniques.

Other applications of the invention involve the production of heat resistant nickel coatings that require repair by welding or brazing (e.g., mold or die faces).

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. An electroformed, hard nickel, screen printing cylinder for exposure in use or manufacture to temperatures exceeding 200° C, said hard nickel portion of said cylinder consisting essentially of, in weight percent: from about 0.007 to about 1% sulfur, sufficient manganese, in the range of from about 0.02 to about 5%, in excess of the stoichiometric amount necessary to form manganese sulfide with the sulfur, to improve embrittlement resistance of said electrodeposit at temperatures exceeding 200° C; and the balance essentially nickel.

2. A cylinder as defined in claim 1, wherein said cylinder contains from about 0.03 to about 3.5% manganese.

3. A cylinder as defined in claim 2, wherein said cylinder contains from about 0.02 to about 0.065% sulfur.

4. A cylinder as defined in claim 1, wherein said cylinder contains from about 0.07 to about 0.35% manganese.

5. A cylinder as defined in claim 4, wherein said cylinder contains from about 0.02 to about 0.065% sulfur.

6. A cylinder as defined in claim 1, wherein said cylinder contains from about 0.1 to about 0.25% manganese.

7. A cylinder as defined in claim 6, wherein said cylinder contains from about 0.02 to about 0.065% sulfur.

8. A cylinder as defined in claim 1, wherein said cylinder contains manganese in an amount at least 0.03% in excess of said stoichiometric amount.

9. A cylinder as defined in claim 1, wherein said cylinder contains at least one element selected from a group consisting of iron and cobalt.

10. A process for preparing a hard nickel screen printing cylinder affording improved resistance to embrittlement at temperatures exceeding 200° C comprising: preparing a nickel electrolyte containing a source of nickel ions, a source of manganese ions, and a source of sulfur; and electrodepositing said cylinder consisting essentially of, in weight percent: from about 0.007 to about 1% sulfur, sufficient manganese, in the range from about 0.02 to about 5%, in excess of a stoichiometric amount necessary to form manganese sulfide with the sulfur, and the balance essentially nickel.

11. A process as defined in claim 10, wherein said source of nickel ions is at least one member selected from the group consisting of nickel sulfate, nickel sulfamate, and nickel chloride.

12. A process as defined in claim 11, wherein said source of sulfur is an aryl compound containing a functional sulfonate group.

13. A process as defined in claim 12, wherein said source of sulfur is sodium benzosulfimide.

14. A process as defined in claim 12, wherein said source of sulfur provides a free sulfur content in the electrolyte of from about 0.01 to about 0.065 grams per liter.

15. A process as defined in claim 12, wherein said electrolyte contains butyne diol.

16. A process as defined in claim 12, wherein said source of manganese ions is at least one member selected from the group consisting of manganese sulfamate, manganese sulfate, and manganese chloride.

17. A process as defined in claim 16, wherein said electrolyte contains said source of manganese ions in an amount sufficient to provide a manganese ion content of from about 12 to about 20 grams per liter.

18. A process as defined in claim 10, wherein said electrolyte is operated at a current density in the range of from about 2.7 to about 20 amperes per square decimeter.

19. A process as defined in claim 10, wherein said electrolyte is operated at a current density in the range of from about 4.3 to about 12.9 amperes per square decimeter.

* * * * *